US008648237B1

(12) United States Patent
Schenk

(10) Patent No.: US 8,648,237 B1
(45) Date of Patent: Feb. 11, 2014

(54) MANDOLIN WITH INTEGRATED ARMREST

(76) Inventor: Roderick Keith Schenk, Silverdale, WA (US)

( * ) Notice: Subject to any disclaimer, the term of this patent is extended or adjusted under 35 U.S.C. 154(b) by 0 days.

(21) Appl. No.: 13/350,725

(22) Filed: Jan. 13, 2012

Related U.S. Application Data

(60) Provisional application No. 61/433,097, filed on Jan. 14, 2011.

(51) Int. Cl.
*G10D 1/02* (2006.01)

(52) U.S. Cl.
USPC ..... 84/268; 84/291

(58) Field of Classification Search
USPC ..... 84/268, 291
See application file for complete search history.

(56) References Cited

U.S. PATENT DOCUMENTS

| | | | | | |
|---|---|---|---|---|---|
| 886,137 | A | * | 4/1908 | Lang | 84/291 |
| D186,826 | S | * | 12/1959 | Fender | D17/14 |
| 4,090,427 | A | * | 5/1978 | Kaman | 84/291 |
| 4,178,827 | A | * | 12/1979 | Mallory | 84/291 |
| D283,899 | S | * | 5/1986 | Peavey | D17/20 |
| D286,299 | S | * | 10/1986 | Peavey | D17/20 |
| D299,834 | S | * | 2/1989 | Clark | D17/20 |
| D309,151 | S | * | 7/1990 | Beard | D17/18 |
| 5,886,272 | A | * | 3/1999 | Regenberg | 84/293 |
| 6,376,755 | B1 | * | 4/2002 | Kammerer | 84/290 |
| 6,664,452 | B1 | * | 12/2003 | Teel | 84/291 |
| D510,593 | S | * | 10/2005 | DeCarolis | D17/20 |
| D529,069 | S | * | 9/2006 | Garrett, Jr. | D17/14 |
| D536,029 | S | * | 1/2007 | Ching | D17/14 |
| 7,169,991 | B2 | * | 1/2007 | Ralbovsky | 84/291 |
| 7,449,624 | B2 | * | 11/2008 | Boute | 84/291 |
| 7,579,534 | B1 | * | 8/2009 | Ryan | 84/291 |
| 7,795,514 | B2 | * | 9/2010 | Kim | 84/267 |
| D629,836 | S | * | 12/2010 | Hoffman | D17/14 |
| D662,539 | S | * | 6/2012 | Mohajerin | D17/14 |
| 2004/0182221 | A1 | * | 9/2004 | Burrell | 84/291 |
| 2007/0044633 | A1 | * | 3/2007 | Gregory | 84/327 |

OTHER PUBLICATIONS

2008 Charis Dream Guitar with armrest, viewed Feb. 21, 2013 at http://www.dreamguitars.com/detail/1114-charis_dream_series_sj_cutaway_193_7_of_10/.*

2007 Charis Acoustics SJ-F Acoustics guitar viewed Feb. 21, 2013 at http://www.dreamguitars.com/new/charis/charis_sj-f_170/charis_sj-f_170.php.*

Martin edwards, registered user post at Mandolin Café on Apr. 4, 2009, anyone else tried an armrest bevel, viewed Feb. 21, 2013 at http://www.mandolincafe.com/forum/showthread.php?49938-any-one-else-tried-an-armrest-bevel.*

* cited by examiner

*Primary Examiner* — Robert W Horn
(74) *Attorney, Agent, or Firm* — James M. Duncan, Esq.; Klein DeNatale Goldner

(57) ABSTRACT

A mandolin having an integrated armrest provides a comfortable armrest while still allowing greater flexibility between the top and the sides of the mandolin, resulting in a construction which does not increase the rigidity of the connection between the carved top and sides of the instrument. Thus, in addition to providing greater comfort, the disclosed integral armrest has minimal negative impact on the sonic quality of the instrument, if any at all.

13 Claims, 12 Drawing Sheets

MANDOLIN WITH INTEGRATED ARMREST

CROSS-REFERENCE TO RELATED APPLICATION

U.S. Provisional Application No. 61/433,097 for this invention was filed on Jan. 14, 2011 for which application this inventor claims domestic priority.

BACKGROUND OF THE INVENTION

The present invention generally relates to mandolins, where the mandolin comprises a fretboard (or fingerboard) whereupon the strings are fingered with the fingers of a musician's first hand to produce a desired musical tone when the strings are plucked, picked, bowed or otherwise actuated by the musician's second hand. The mandolin comprises a sound chamber, or body, in which sound waves generated by the plucked strings are amplified by the vibrations of the materials forming the sound chamber and emitted from the sound chamber. The sound chamber is made up of the front (also referred to as "top" or "carved top"), back and sides.

For a right-handed player, the right hand is typically utilized for bowing, picking, strumming, or otherwise actuating the strings of the mandolin. For the remainder of this description, it will be assumed that the instrument is "right handed", i.e., built to be played by a right-handed person. However, correlating the description for a left-handed instrument only requires the assumption that the right hand is utilized for fingering the notes and the left hand is utilized for bowing, picking or strumming the strings.

The sides of the mandolin may, for purposes of description, be identified with respect to the strings. The treble strings of the mandolin are on the side of the instrument generally facing downward as the instrument is played, while the bass strings are on the side of the mandolin generally facing upward as the instrument is played. Using the strings as a point of reference, the sides of a mandolin may be referred to as the treble side and the bass side. With respect to the string orientation described above, the side of the mandolin generally facing downward while played is considered as the treble side of the instrument and the side of the instrument facing upward is considered as the bass side of the instrument.

For the typical right-handed player, the portion of the sound chamber where the neck of the mandolin attaches is adjacent to the player's left arm, and the rounder teardrop area of the sound chamber is adjacent to the player's right arm. The left hand is utilized for fingering notes on the fretboard, where the fretboard is disposed on the neck of the instrument. For most mandolins, a portion of the fretboard cantilevers over the carved top. The portion of the fretboard cantilevering over the carved top is typically referred to as the fretboard extension.

Under the traditional design for mandolins there are two predominant styles. The first is called the "F-Style" and has ornate appointments like carved scrolls and points that are primarily for aesthetic beauty. The F-Style mandolin generally features f-shaped holes for the sound holes carved into the carved top. The second design is called an "A-Style" mandolin which is similar to the F-Style except the former generally has a relatively simple appearance by excluding all the ornate features like scrolls and points. A-Style mandolins often implement a round or oval shaped sound hole on the carved top as opposed to the f-shaped holes of the F-Style. However, over the years, instrument makers have modified each traditional design, combining features of both, resulting in hybrid designs. While the drawings included herein generally depict F-Style mandolins, the disclosed integrated armrest may also be fabricated into a A-Style mandolin without any significant variation in the fabrication method and as known by those skilled in the art of the invention.

As opposed to instruments which are bowed, such as a violin, where the notes continue to sound as the instrument is bowed, the notes played on a mandolin, like other plucked instruments, gradually decay to silence. Because of its small size and higher pitch, the notes of a mandolin will also typically decay faster than notes played on larger plucked stringed instruments, such as guitars. For various types of music, it is desirable that the time for the plucked notes to decay to silence be extended, that is sustained. It is also desirable that mandolins have sufficient volume such that the sound of the instrument is not lost amid the sounds of other instruments or background noise.

The volume of an instrument and the ability of the instrument to sustain plucked notes are generally a function of the instrument's ability to produce and transmit sonic energy. This characteristic of a particular instrument is impacted by a variety of factors, including the materials used in the instrument, the geometry of the instrument, and the manner in which the instrument is fabricated. Mandolins are constructed to physically and sonically vibrate the carved top by transferring vibration energy from a plucked string through the bridge directly into the carved top, which acts as a vibrating membrane creating sound wave energy. The vibrating top, in unison with the vibrating back, produces a "pumping action" resulting in differential air pressure within the sound chamber. This "pumping action" greatly contributes to the melodic sound of the mandolin. It should be understood that both the front and the back vibrational capacity of the mandolin are paramount for creating the melodic sonic tones and notes expected from a mandolin. Higher frequency (treble) sound waves are produced and emitted directly off the top face of the carved top. Lower frequencies (bass) are produced by the carved top vibrating the air inside the mandolin body, emitting the lower frequency sound waves through the openings discussed above. The greater the carved top vibration, the greater the sound wave energy produced. Secondary but noticeable tonal sound energy waves also come from the vibrating sides and carved back of the mandolin. Thus, the sound chamber is ideally designed to be as sonically active as possible. However, the sound chamber may be negatively influenced by any structures which impede its vibration. Such structures include the detachable armrests which are commonly utilized on mandolins.

Mandolins may have separate ergonomic armrests which may be attached to either the upper sides of the mandolin, to the top, or, most commonly, to the top, back and sides together. The armrest comprises a resting member for the player's arm and attachment means for mechanically attaching the armrest to some part of the sound chamber. The armrest will generally be located on the bass side of the sound chamber on top of the mandolin. The known armrests are aftermarket products designed to be removable from the mandolin body. However, because these armrests attach to the sound chamber, the means of attachment and extra weight of the armrest inhibit vibration, as well as the sound chamber "pumping action" ability, resulting in decreased sound energy and a less resonant top and back. In addition to stiffening the carved top, the known mandolin armrests, and associated support structures, stiffen the sides of the instrument, thus reducing the secondary tonal sound energy waves coming from the vibrating sides and carved back of the mandolin. This decrease in the vibrational capacity of a mandolin results in diminished sound energy, particularly because the known armrests are immediately adjacent to the most sonically active area of the sound board.

The present invention overcomes the above-described problem by implementing an integrated armrest constructed utilizing a "flexible" or "pinned" connection. This manner of construction is preferable to attached armrests which create added weight and impair the flexibility of the connections between the front, side, and back of the instrument due to the nature of the mechanical connection of traditional mandolin armrests. The disclosed armrest is not simply achieved by beveling the side and top of the instrument, which requires the utilization of structures which stiffen the connections between the front, side and back of the instrument. Instead, the disclosed armrest utilizes a modified support member not currently known in the art.

SUMMARY OF THE INVENTION

The disclosed mandolin with the integrated armrest is constructed in a manner consistent with the physical laws and behavior of mechanical connections, as to not rigidly connect the top to the supporting sides of the mandolin, but rather to create a flexible connection. Mandolins are generally constructed such that, when traced around the body of the instrument, the connection between the top and sides of the mandolin has a consistent ninety degree angle immediately adjacent to the interface of the side and the top. The disclosed integrated armrest is distinctive from the prior art in that the disclosed armrest is not a separate apparatus which is mechanically attached to the instrument, but is rather integrated into the carved top design. This design provides a comfortable armrest while still allowing greater flexibility between the carved top and the sides of the mandolin, resulting in a construction which does not increase the rigidity of the connection between the carved top and sides of the instrument. Thus, in addition to providing greater comfort, unlike the prior art armrests, the disclosed integral armrest has minimal negative impact on the sonic quality of the instrument, if any at all. As applied in the present invention, the integrated armrest has limited invasion into the top of the instrument, which is distinctive from the integrated armrests of other instruments in which the armrest substantially invades the top of the instrument, adversely impacting the sonic character of the instrument.

The disclosed armrest, and method of constructing the same, comprises the following features:

In one embodiment, the armrest support kerfing may be, with respect to the interface between the top and side, no deeper than, and is not positioned lower than the kerfing utilized for attaching the carved top to the portions of the side which are not adjacent to the armrest support kerfing (referred to hereinafter as the "standard kerfing"). That is while the armrest support kerfing is different from the standard kerfing, the depth of the armrest support kerfing is not necessarily increased and the armrest support kerfing may be configured such that it does not extend any further down the side of the mandolin than the standard kerfing. Therefore, joint stiffness moment capacity at the connection of the top and side adjacent to the armrest is similar to the joint stiffness moment capacity for the rest of the mandolin without a traditional armrest attached.

The inside edge of the disclosed armrest may be fabricated such that it does not extend into the top of the instrument more than three times the depth of the binding (i.e., more than ¾ of an inch) from the outside face of the supporting sides.

The outside edge of the armrest on the mandolin side may or may not extend past the intersection of the binding and the wood of the mandolin sides, according to the desires of the musician. The mandolin sides are generally the same geometric configuration as is if an armrest were not installed but may differ slightly if a larger armrest was desired. The armrest would typically only encroach into the binding portion of the side of the mandolin unless a deeper armrest was desired.

The present invention achieves several objectives and advantages. A mandolin armrest of the present design allows a comfortable armrest, utilizing a chamfer, without compromising the sonic qualities of the carved top or deviating significantly from the appearance of a conventional mandolin. The disclosed mandolin has proportional geometries which maximize the amount of chamfer permitted for the armrest without noticeably affecting the tonal qualities of the instrument. The "connection depth" is minimized, which reduces the connection's moment resisting capacity, thereby creating a more flexible connection allowing more carved top vibration, "pumping action", as well as, secondary side vibration. The present armrest may be installed with little reduction of the carved top area where the carved top is most sonically active. The integrated armrest eliminates the need for the mechanically attached armrest, thereby decreasing any dampening effects imposed by the attachment of the prior art armrest to the mandolin. In addition, the present armrest incorporates a hardwood graft member into the carved top, which provides a structural anchor to the veneer plate, which forms the outside surface of the armrest.

DETAILED DESCRIPTION OF THE EMBODIMENTS

Figure 1:
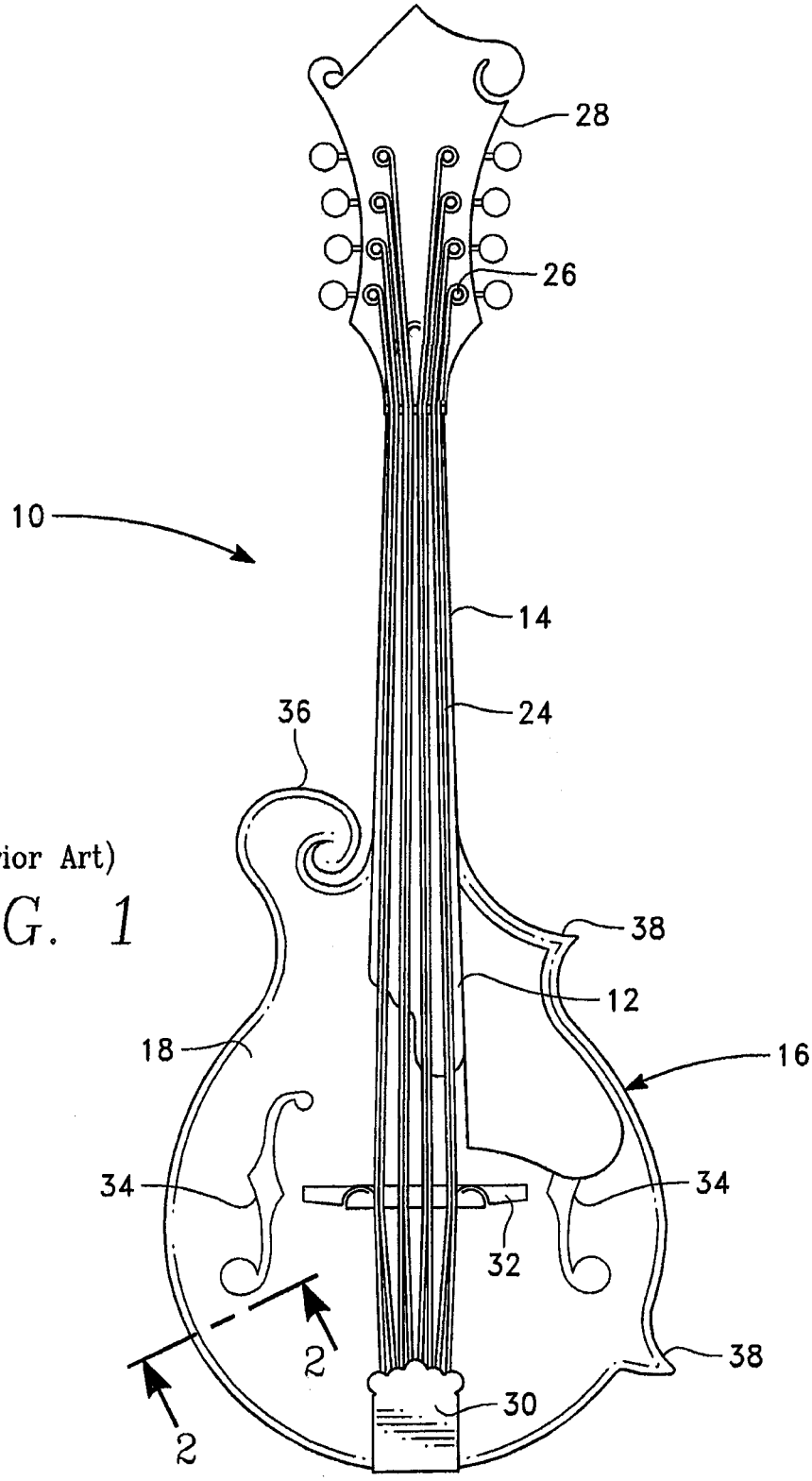
(Prior Art) FIG. 1
FIG. 1 shows an embodiment of a known F-Style mandolin having no armrest, either of the prior art variety or the disclosed integrated variety.
Figure 2:
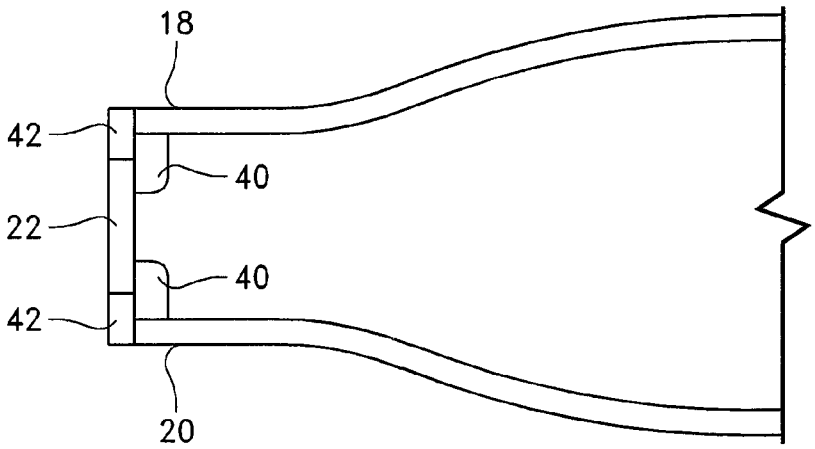
(Prior Art) FIG. 2
FIG. 2 schematically shows a cross-section along line 2-2 of FIG. 1, showing the relation of the side, the binding, the top, and the standard kerfing of the known mandolins
Figure 3:
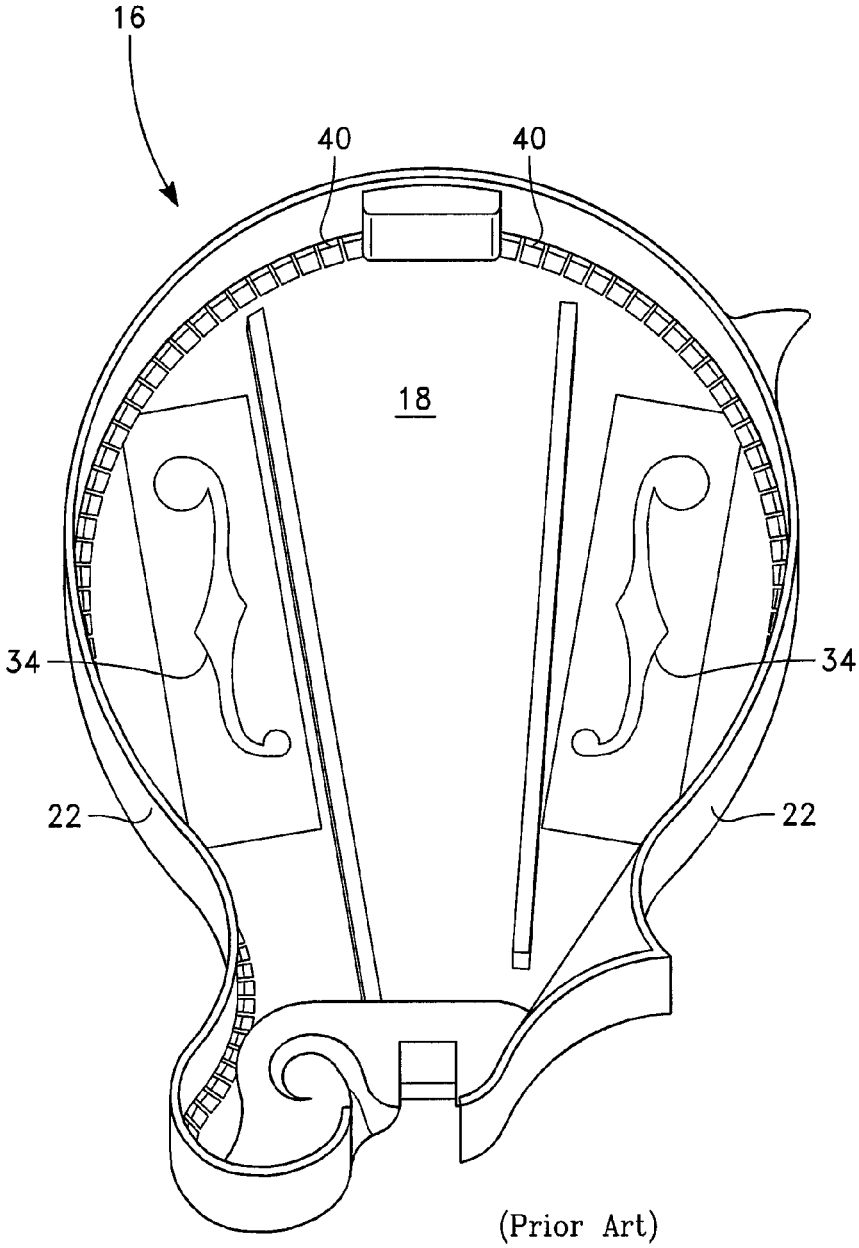
(Prior Art) FIG. 3
FIG. 3 shows a portion of a prior art mandolin, having the back removed.

Referring now to the figures, an F-Style mandolin 10 having no armrest at all is generally depicted in FIGS. 1-3. The mandolin 10 comprises a fingerboard 12 which is supported by the neck 14 which is attached to sound chamber 16, where a longitudinal axis is defined by the sound chamber and the neck For mandolins, the sound chamber 16 has a front 18 (also referred to as the carved top or top), back 20, and curved sides 22. The front 18 and back 20 of the mandolin 10 are typically fabricated from wood blanks, usually spruce and maple, and carved into thin dish-like shapes, typically constituting the front 18 and back 20.

The mandolin 10 further comprises strings 24, which are attached on one end of the string to tuning machines 26 attached in headstock 28, which is positioned at the end of the neck 14 extending from the sound chamber 16. The opposite end of each string is attached to a member called the tail-piece 30 which is attached to the end of the sound chamber 16 opposite from the end where the neck 14 meets the sound chamber 16. A member called a bridge 32 is located under the strings 24 near the center of the outside surface of front 18, where the bridge elevates the strings above the front. The bridge 32 is held in place by the downward pressure the strings 24 exert toward the front 18. The strings 24 are typically disposed above or adjacent to openings in the front such as f-holes 34, or a single round or oval sound hole as known in the art.

Figure 5A:
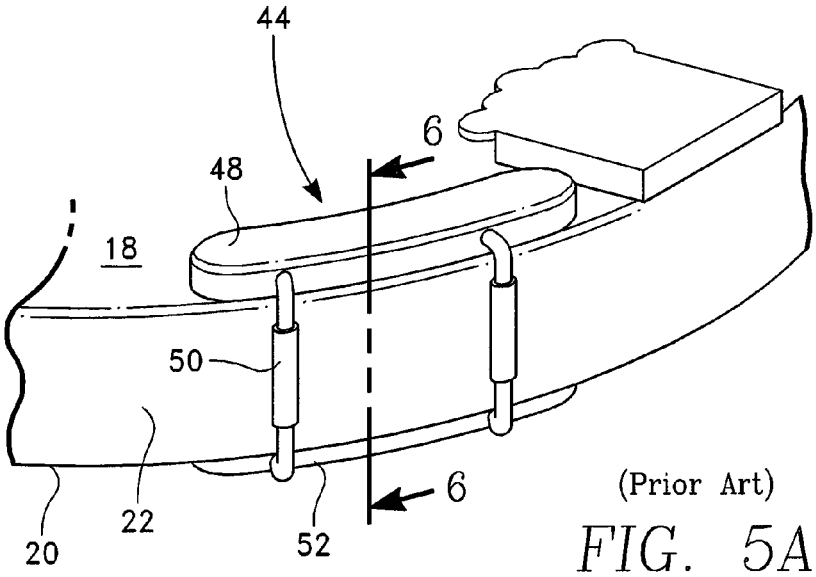
(Prior Art) FIG. 5A
FIG. 5A shows the prior art armrest attached to a known mandolin.
Figure 6:
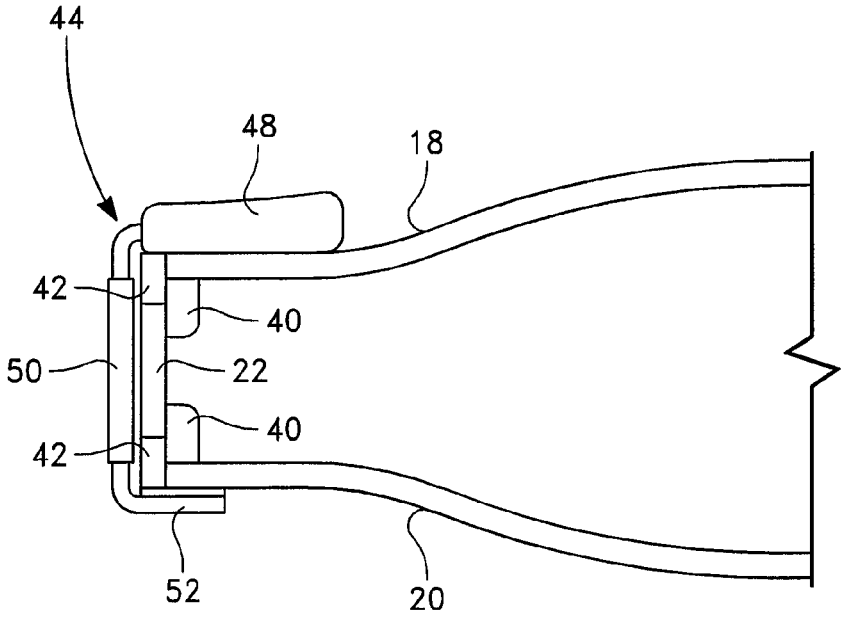
(Prior Art) FIG. 6
FIG. 6 schematically shows a cross-section along line 6-6 of FIG. 5, showing how the prior art armrest clamps around the side of the instrument.

The sides 22 of the mandolin 10 are fabricated from a relatively thin material which allows the sides to be bent to achieve the various curved shapes utilized for mandolins, such as the tear shape. As suggested by FIG. 3, the "sides" 22 may actually be fabricated from a single strip of material which is formed to achieve the desired outline of the instrument. Thus, the reference to sides 22 is defined herein to refer either to a single strip of material which is formed to the desired curvature, or two or more strips joined together. The thickness of the mandolin, i.e., the dimension between the front 18 and back 20 as best shown in FIGS. 5A and 6, is relatively small in comparison to other plucked instruments, such as acoustic guitars. Under the traditional design of mandolins, the shape of the sound chamber 16 is in the shape of a teardrop with the upper end of the teardrop adjacent the neck 14 and the rounded end of the teardrop adjacent the tailpiece 30. Mandolins often times have ornate components called scrolls 36 and points 38. These appointments may be attached to the sound chamber 16 in various positions and function primarily for aesthetical beauty rather than the impact on the tonal quality of the instrument.

Due to the nature of the front 18, back 20 and sides 22 of mandolin 10, these components typically have a wall thickness of less than 0.100 inches, typically ranging from 0.085 to 0.100 inches. Because of the thin wall thickness, the available gluing surface for attaching the front 18 and back 20 of the mandolin 10 to the sides 22 is quite small. To provide greater strength to these joints, it is known to attach strips of kerfing 40, usually with glue, to the inside facing surface of the sides 22 of the mandolin 10, as shown in FIGS. 2-3, to act as support members for the front 18 and the back 20. The kerfing 40 is a flexible strip of wood which typically has parallel cuts known as "kerfs" intermittently spaced along the length of the strip to provide flexibility to the strip. The kerfing 40 provides support and surface area for gluing. In the usual application, the kerfing 40 will provide additional contact area for providing a gluing surface where a relatively strong bond between the various wood members is required. When applied, the kerfing 40 provides a wider surface to support the front 18 and/or back 20 as each are joined along their peripheral edges to the sides 22. The front 18 and back 20 are typically attached to the kerfing 40 by glue or other attachment means. Without the support provided by the kerfing 40, the edge of sides 22 does not provide sufficient surface area to create a strong enough joint to hold the two thin components together with glue, or other attachment means.

As generally shown in FIG. 2, under the known mandolin design, the front 18 and sides 22 of the mandolin 10 are, at the point of attachment, at right angles to one another, defining an edge. This edge may have a binding material 42, such a wood, plastic, or other trim, which protects the corner of the carved top and side from impact damage.

Among other things, the capacity and amplitude of the vibration of the front 18 is controlled by the connection of the front to the supporting sides 22 of the mandolin. A "simple" or "pinned" connection is a preferred connection because it results in a more flexible connection of the front 18 to the sides 22 of the mandolin, thereby increasing the vibration capacity of the front. In contrast, a "moment" or "fixed" connection, which rigidly attaches the front 18 to the supporting sides 22, is not a preferred connection, because it allows transfer of moment forces to the sides of the instrument, thereby reducing vibration of the front and dampening the acoustic energy.

Figure 4:
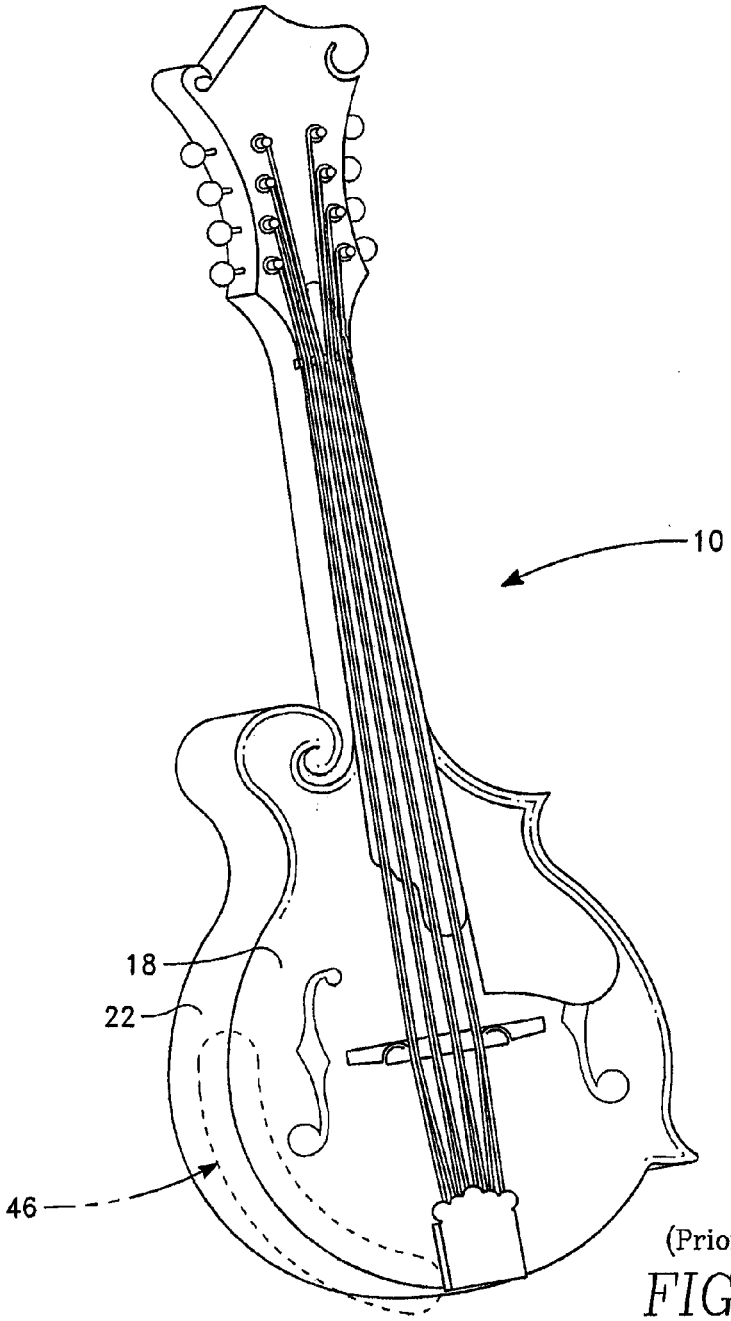
(Prior Art) FIG. 4
FIG. 4 shows an F-Style mandolin, showing the general location along the bass side for a prior art armrest, at the junction of the side and the carved top.

FIG. 4 shows the general location along the bass side of a mandolin 10 where known armrests 44 may be attached at the junction 46 of the side 22 front 18 and back 20 of the mandolin.

Figure 5:
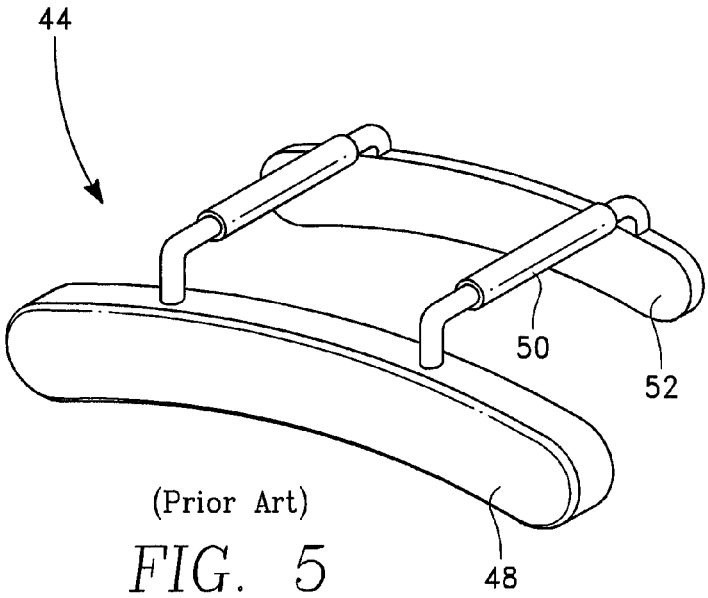
(Prior Art) FIG. 5
FIG. 5 shows a prior art armrest.
Figure 7:
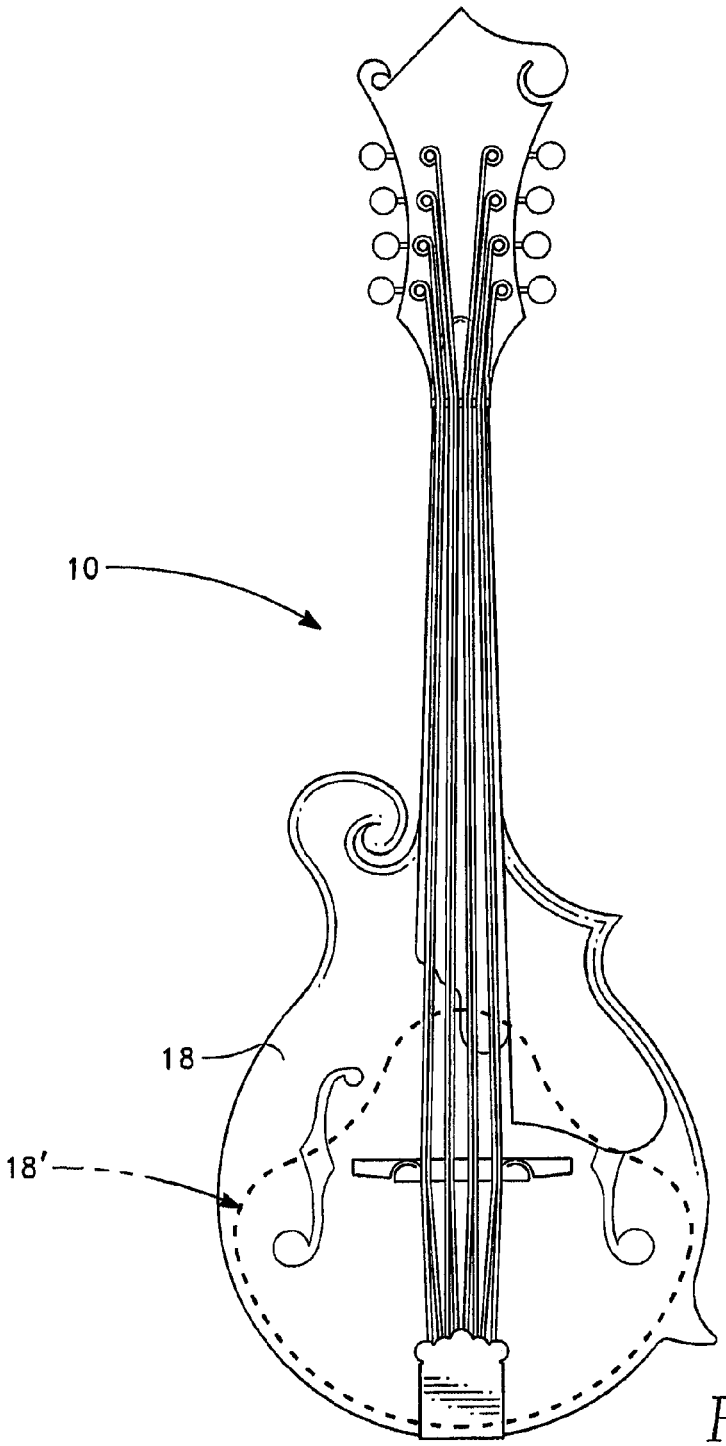
FIG. 7 illustrates the area of the carved top of a mandolin, which is believed to be the most sonically active area of the carved top.

FIG. 5 shows a known armrest 44 which generally comprise a rest member 48, adjustable attachment links 50 and support member 52. As shown in FIG. 5, for this type of armrest 44, the sound chamber 16 is "sandwiched" between the rest member 48 and the support member 52. As shown in greater detail in FIG. 5A, it should be noted that the known armrest 44 encroaches into the side 22 of the mandolin 10 into the front 18 and into the back 20 of the mandolin 10. This encroachment results in mechanical interference with the vibrations of the front 18. In addition, the known armrests 44 can be heavy, and the weight itself can adversely impact the sonic characteristics of the instrument. FIG. 6 shows a schematic of a cross-section along line 6-6 of FIG. 5A, which shows the relation of the side 22, the back 20 and the front 18 having a prior art armrest 44. This figure also shows the amount of encroachment of the rest member 48 over the front 18 and back 20, as the armrest is clamped into position. By its very design, the known armrest 44 must be clamped tightly to the instrument, resulting in mechanical interference with the vibrations and "pumping action" of the instrument, which has an adverse influence on the acoustic properties of the instrument. Unfortunately, the positioning of the armrest 44 is positioned in a portion of the most sonically active area of the front 18, which is generally depicted in FIG. 7 as 18'.

Figure 8:
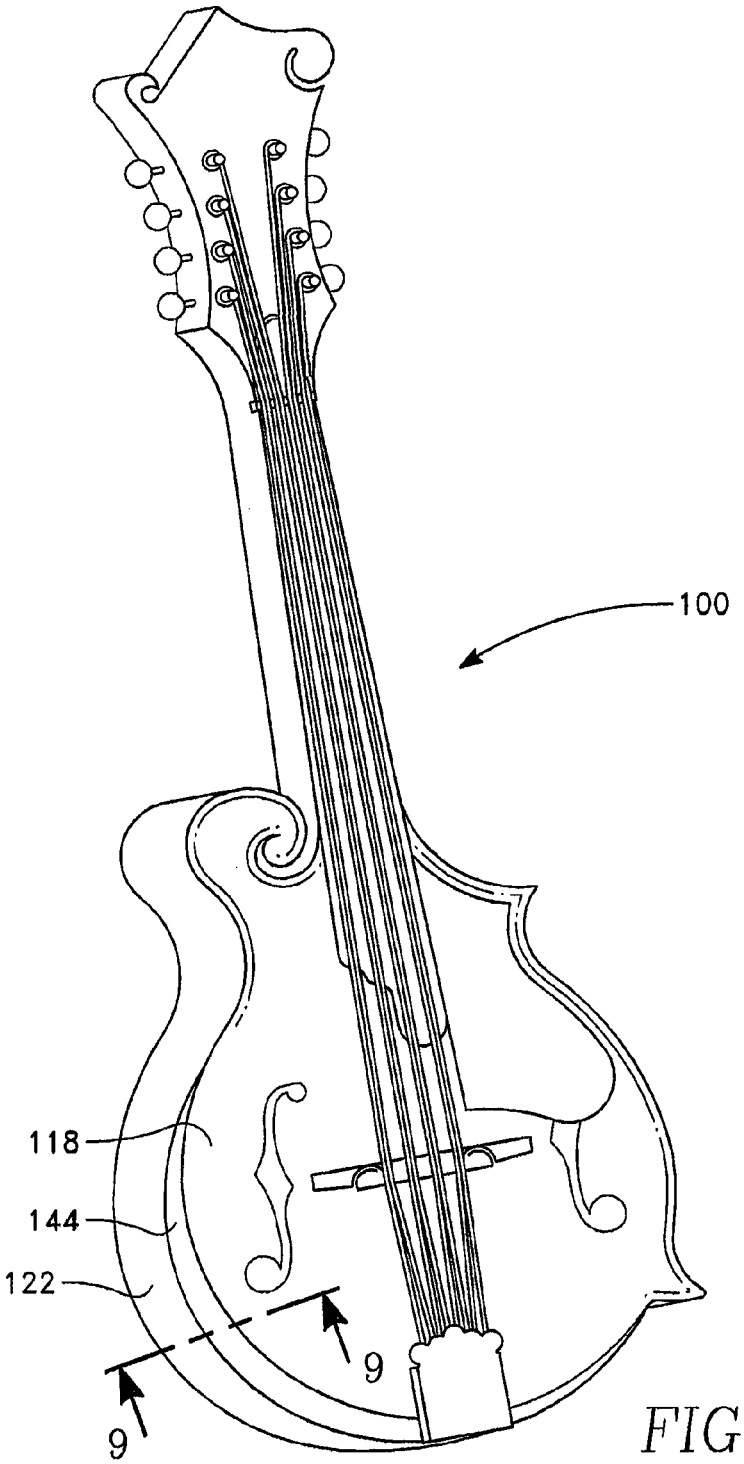
FIG. 8 shows a mandolin having an embodiment of the presently disclosed integral armrest.
Figure 9:
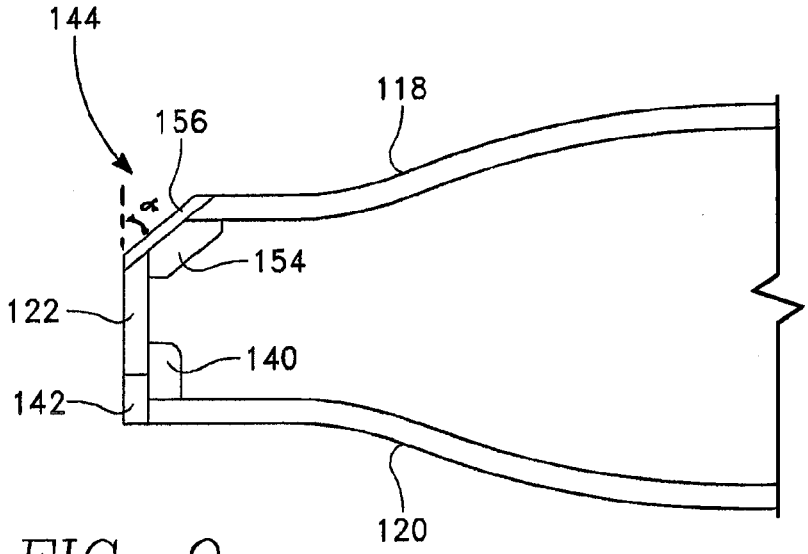
FIG. 9 schematically shows a schematic of a cross-section along line 9-9 of FIG. 8.

FIGS. 8 and 9 depict a mandolin 100, of the F-Style, having an embodiment of the presently disclosed integrated armrest 144. It should be noted that, in contrast to the armrest 44 depicted in FIGS. 5 and 6, no attachment mechanisms are required for the integrated armrest 144. As discussed above, such mechanisms impair the vibration of the front 118, back 120, and sides 122, and add additional weight to the instrument. It should be noted that the integrated armrest has no impact on reducing the vibrational capacity of the back 120. FIG. 9 schematically shows the relationship between the front 118, the back 120, the sides 122, and the integrated armrest 144.

The kerfing 140 which is utilized to attach the back 120 to the sides 122 is comparable to that utilized with the known mandolins 10. However, the integrated armrest 144 is formed by a piece of armrest support kerfing 154 which is utilized to join the front 118 to side 122 along a portion of the bass side of the lower bout of the instrument as best shown in FIGS. 9 and 10. It is to be appreciated that while referred to as "armrest support kerfing", this member will typically be fabricated from solid material formed to the require curvature, and will not comprising the parallel kerfs found in conventional kerfing material.

Figure 10:
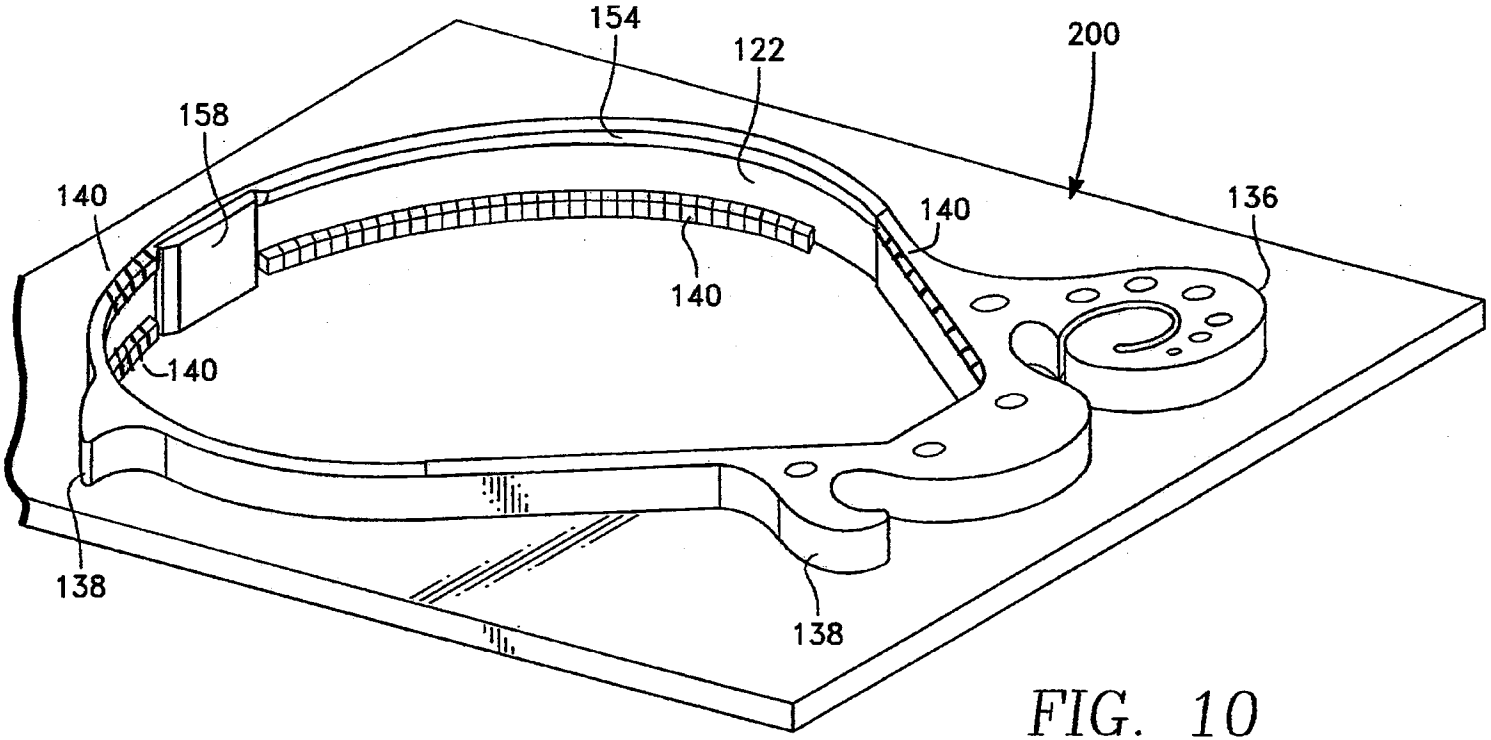
FIG. 10 shows the forming of the sides of a mandolin being constructed within a form, showing the placement of the integrated armrest of the present invention.

The joint between the integrated armrest 144 and the back 120 may continue to be finished with binding material 142, as shown in FIG. 9. Cover piece 156, which may comprise a wood or plastic veneer, is attached to the outside facing surface of armrest support kerfing 154 to complete the integrated armrest 144. As indicated by FIG. 9, the outside facing surface of the armrest support kerfing 154 may be disposed such that the outside facing surface has angle $\alpha$, which may range from 20 up to 70 degrees from the orientation of side 122, which is illustrated in FIG. 9 as vertical FIG. 10 depicts the sides 122 of the mandolin 100 being formed within a forming template 200. The kerfing 140, to which the back 120 is attached, will generally extend around the sides 122 in the same way as kerfing 40 extends around sides 22 as depicted in FIG. 3, although FIG. 10 does not show all of this kerfing. In addition, except for the portion of the front 118 supported by armrest support kerfing 154, the remainder of the front is supported by kerfing 140 which is placed on either side of the armrest support kerfing as indicated in FIG. 10. In other words, front 118 is attached along its circumferential edges to sides 122 to both armrest support kerfing 154 and kerfing 140. The armrest support kerfing 154 supports a portion of the front along its circumferential edge and kerfing 140 supports a substantial remainder of the front along its circumferential edge. In addition, the front 118 is supported by tail block 158. But for the support provided by the armrest support kerfing 154, front 118 is supported in similar fashion by kerfing 140 as front 18 is supported by kerfing 40 for the known construction as shown in FIG. 3.

Figure 11:
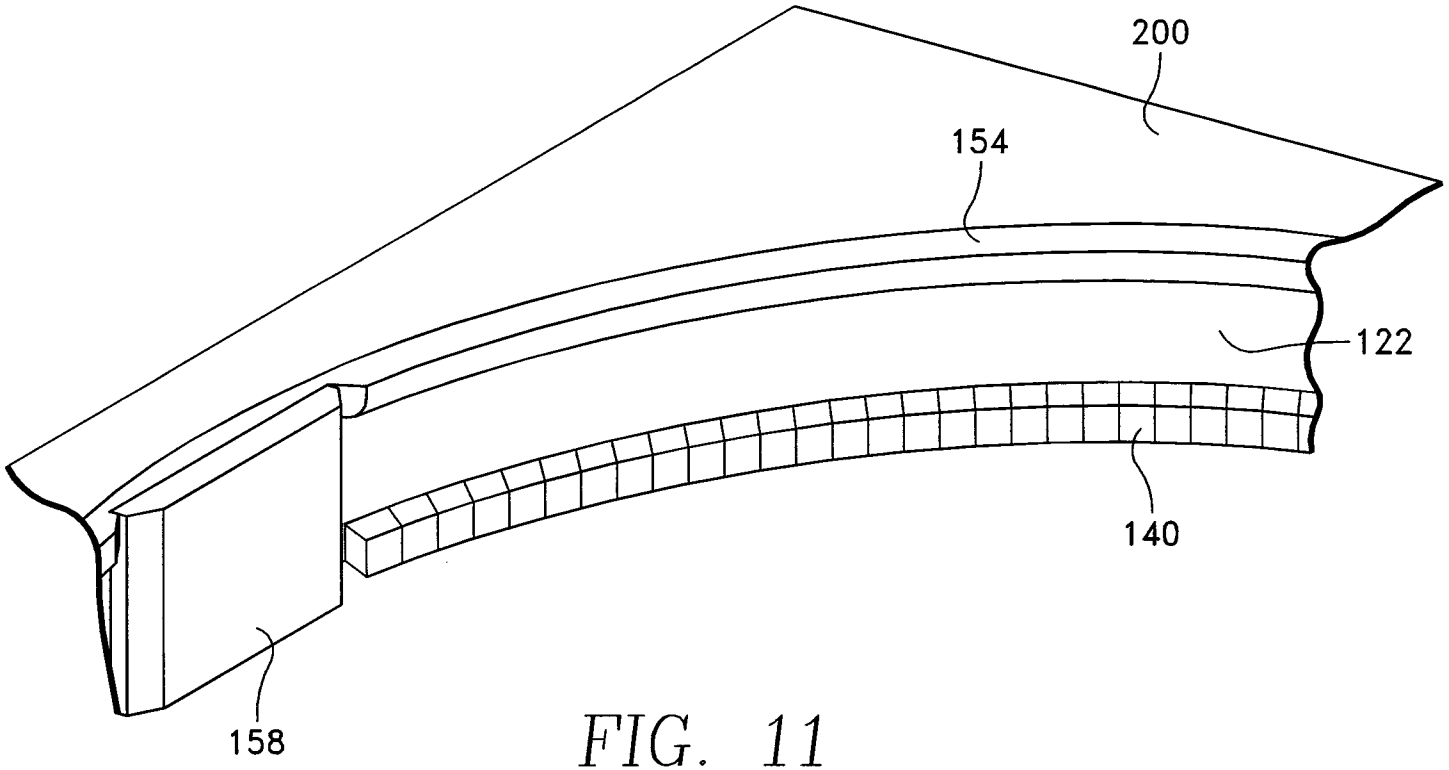
FIG. 11 shows a detailed view of the armrest kerfing of the present invention as being constructed within a form.

FIG. 11 shows a closer view of the armrest support kerfing 154 in comparison to the underlying standard kerfing material 140 utilized for attaching the back 120 to the mandolin 100.

Figure 12:
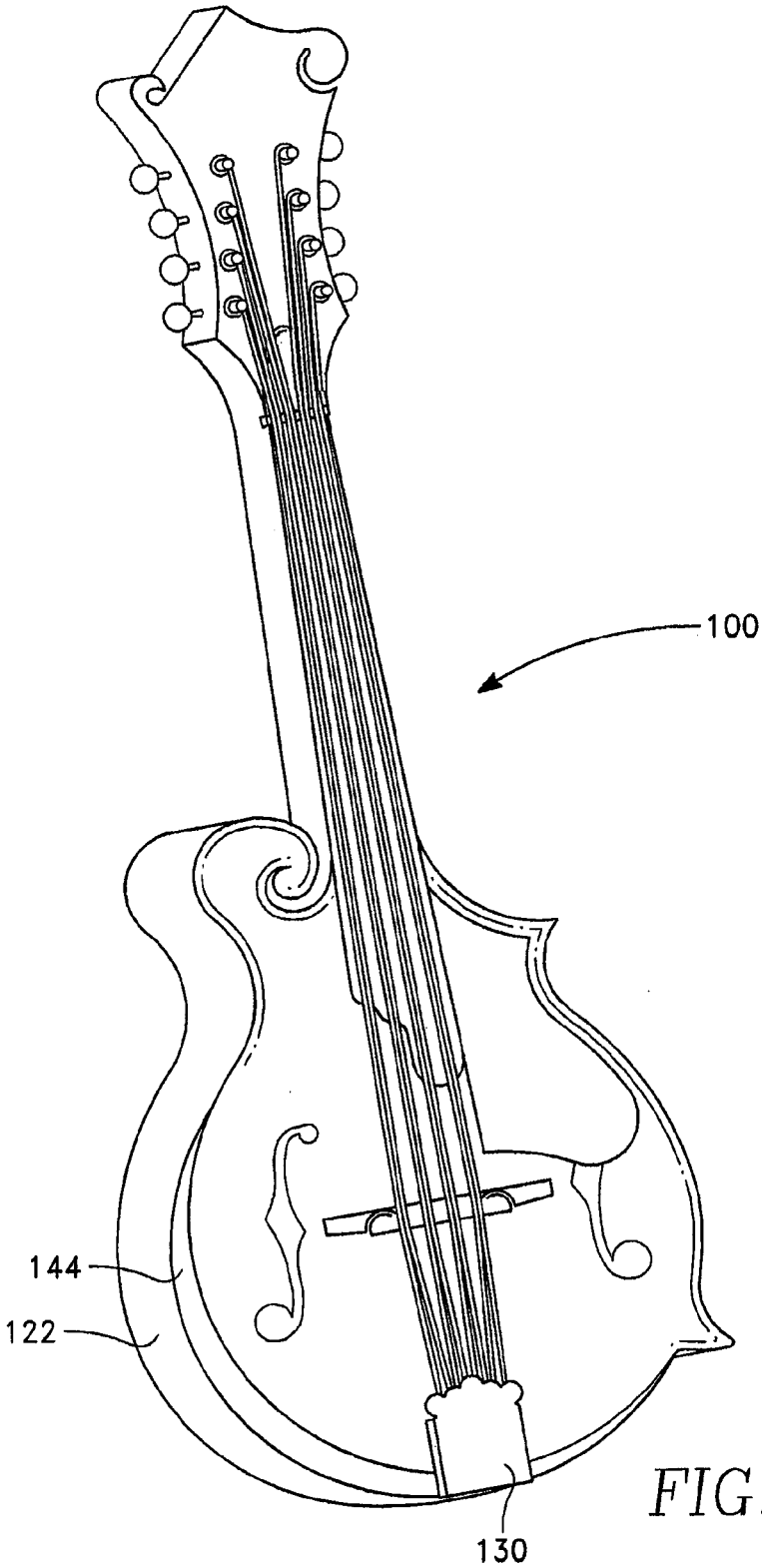
FIG. 12 shows a completed mandolin having an embodiment of the integrated armrest.

FIG. 12 shows an embodiment of the completed integrated armrest disposed on the upper bass side of the front 118 of the mandolin 100.

It is to be appreciated that while the above is a description of various embodiments of the present invention, further modifications may be employed without departing from the spirit and scope of the present invention. Thus the scope of the invention should not be limited according to these factors, but according to the following appended claims.

What is claimed is:

1. A mandolin comprising:

a sound chamber defined by a front, a curved side member, and a back, the front and back attached to the curved side member, the front and back in general facing relation;

a neck attached to the sound chamber wherein a longitudinal axis is defined by the sound chamber and the neck;

a headstock positioned at the end of the neck opposite the sound chamber;

a tailpiece attached to the sound chamber;

a plurality of strings, including bass strings and treble strings, the strings positioned above the front and oriented along the longitudinal axis, wherein a portion of the mandolin adjacent to the bass strings is defined as the bass side, wherein a first end of each string is attached to the headstock and a second end of each string is attached to the tailpiece;

a bridge disposed between the strings and the front of the sound chamber;

the curved side member comprising an inside facing surface comprising a first support member for supporting the front and a second support member for supporting the back;

the first support member comprising a first section and a second section, the first section comprising a plurality of parallel oriented kerfs and the second section comprising a solid armrest support member, the solid armrest support member extending from a first point on the bass side to a second point adjacent to the tailpiece, the armrest support member comprising an outwardly facing surface; and a cover member attached to the outwardly facing surface.

2. The mandolin of claim 1 wherein the second support member comprises a plurality of parallel oriented kerfs.

3. The mandolin of claim 1 wherein the outwardly facing surface is angled from 20 degrees to 70 degrees from the orientation of the inside facing surface.

4. The mandolin of claim 1 wherein a cover member is attached to the outwardly facing surface.

5. A mandolin comprising:

a sound chamber defined by a front, sides, and a back;

a neck attached to the sound chamber wherein a longitudinal axis is defined by the sound chamber and the neck;

a headstock positioned at the end of the neck opposite the sound chamber;

a tailpiece attached to the sound chamber;

a plurality of strings, including bass strings and treble strings, the strings positioned above the front and oriented along the longitudinal axis, wherein a side of the mandolin adjacent to the bass strings is defined as the bass side, wherein a first end of each string is attached to the headstock and a second end of each string is attached to the tailpiece;

a bridge disposed between the strings and the front of the sound chamber;

the sides comprising an inside facing surface having an orientation generally normal to the front and back, the inside facing surface comprising a first support member for supporting the front and a second support member for supporting the back, the first support member comprising an armrest support member extending from a first point on the bass side to a second point adjacent to the tailpiece; and the armrest support member having an outwardly facing surface, the outwardly facing surface angled from 20 degrees to 70 degrees from the orientation of the inside facing surface.

6. The mandolin of claim 5 wherein the first support member comprises a first section and a second section, the first section comprising a plurality of parallel oriented kerfs and the second section comprising the armrest support member.

7. The mandolin of claim 5 further comprising a cover member attached to the outwardly facing surface.

8. The mandolin of claim 5 wherein the second support member comprises a plurality of parallel oriented kerfs.

9. A mandolin comprising:

a sound chamber formed by a curved side member enclosed with a front, and a back, wherein the curved side member comprises a first support member, the first support member comprising a first surface for engaging a circumferential edge surface of the front, a second surface for engaging an edge of the curved side member, and an outward facing surface;

a neck attached to the sound chamber wherein a longitudinal axis is defined by the sound chamber and the neck;

a headstock positioned at the end of the neck opposite the sound chamber;

a tailpiece attached to the sound chamber;

a plurality of strings, including bass strings and treble strings, the strings positioned above the front and oriented along the longitudinal axis, wherein a side of the sound chamber adjacent to the bass strings is defined as the bass side, wherein a first end of each string is attached to the headstock and a second end of each string is attached to the tailpiece; and an integrated armrest disposed in the bass side extending to a point adjacent to the tailpiece, the armrest comprising the outward facing support surface.

10. The mandolin of claim 9 wherein the curved side member further comprises a second support member for supporting the back.

11. The mandolin of claim 9 wherein the first support member comprises a first section and a second section, the first section comprising a plurality of parallel oriented kerfs and the second section comprising the outward facing surface.

12. The mandolin of claim 9 further comprising a cover member attached to the outwardly facing surface.

13. The mandolin of claim 10 wherein the second support member comprises a plurality of parallel oriented kerfs.

* * * * *